US006696395B1

(12) United States Patent
Woo et al.

(10) Patent No.: US 6,696,395 B1
(45) Date of Patent: Feb. 24, 2004

(54) PERFUMED LIQUID HOUSEHOLD CLEANING FABRIC TREATMENT AND DEODORIZING COMPOSITIONS PACKAGED IN POLYETHYLENE BOTTLES MODIFIED TO PRESERVE PERFUME INTEGRITY

(75) Inventors: Ricky Ah-Man Woo, Hamilton, OH (US); Steven Reece, Hamilton, OH (US); Alen David Streutker, Florence, KY (US); Kimberly Ann Ireton, Williamsburg, OH (US); Mark David Fritz, Cincinnati, OH (US); Eva Schneiderman, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/936,401

(22) PCT Filed: Mar. 17, 2000

(86) PCT No.: PCT/US00/07137

§ 371 (c)(1),
(2), (4) Date: Sep. 11, 2001

(87) PCT Pub. No.: WO00/55292

PCT Pub. Date: Sep. 21, 2000

Related U.S. Application Data

(60) Provisional application No. 60/125,043, filed on Mar. 18, 1999.

(51) Int. Cl.[7] ..... C11B 3/50

(52) U.S. Cl. ..... 510/101; 512/1; 206/484

(58) Field of Search ..... 206/484; 510/101; 512/1

(56) References Cited

U.S. PATENT DOCUMENTS

| | | | | |
|---|---|---|---|---|
| 4,546,882 A | * | 10/1985 | Hsu et al. | 206/484 |
| 4,869,859 A | | 9/1989 | Eschwey et al. | |
| 4,919,834 A | | 4/1990 | Chen et al. | |
| 5,531,339 A | | 7/1996 | Yamanaka et al. | |

FOREIGN PATENT DOCUMENTS

| | | | |
|---|---|---|---|
| EP | 0 300 385 A2 | | 1/1989 |
| EP | 0 641 719 A1 | | 3/1995 |
| JP | 55-133920 | * | 10/1980 |
| JP | 4-91943 | * | 3/1992 |
| WO | WO 96/04940 | | 2/1996 |
| WO | WO 97/49616 | * | 12/1997 |
| WO | WO 98/56337 | | 12/1998 |

* cited by examiner

*Primary Examiner*—John Hardee
(74) *Attorney, Agent, or Firm*—Mark A. Charles; Jason J. Camp; Brahm J. Corstanie

(57) ABSTRACT

Bottle aqueous household cleaning, fabric treatment and deodorizing compositions comprising surfactant, and a perfume which contains a substantial proportion of hydrophobic perfume ingredients having a ClogP of greater than 3. The bottles are made of high density polyethylene wherein the bottles have a continuous inner surface layer of nylon, polyetheneterephthalate or fluorinated polyethylene in order to prevent migration into and/or transmission through the high density polyethylene of the hydrophobic perfume ingredients.

8 Claims, No Drawings

PERFUMED LIQUID HOUSEHOLD CLEANING FABRIC TREATMENT AND DEODORIZING COMPOSITIONS PACKAGED IN POLYETHYLENE BOTTLES MODIFIED TO PRESERVE PERFUME INTEGRITY

This application claims the benefit of Provisional application Ser. No. 60/125,043, filed Mar. 18, 1999.

FIELD OF THE INVENTION

The present invention relates to stable aqueous perfumed household cleaning and deodorizing compositions containing a surfactant and a perfume. The perfume is in a solubilized or emulsified state and contains a substantial proportion of hydrophobic perfume materials in order to impart a clean, desirable, scent to substrates upon which the product is used. The composition is packaged in a polyethylene bottle wherein the interior of the bottle has been modified in order to prevent undesirable changes in the perfume caused by absorption and/or transmission of the hydrophobic components into and/or through the polyethylene during storage.

BACKGROUND

It is recognized that consumers appreciate household cleaning, fabric treatment and deodorizing products which impart a pleasant odor to surfaces treated with said products. It has been found that in the formulation of perfumes for said products, the use of a substantial proportion of hydrophobic perfume materials in said perfumes is desirable.

For convenience and flexibility in use, it is highly desirable that household cleaning and deodorizing and fabric treatment compositions be in liquid form and packaged in plastic bottles. For cost reasons, polyethylene is a preferred material for manufacturing bottles for such compositions. It has been found however, that hydrophobic perfume materials have a tendency to be lost from the liquid product by absorption into and/or transmission through the polyethylene during storage of the composition. This results in a change in the odor character of the composition and a reduction in the fragrance benefit which would otherwise be obtained on surfaces treated with the composition.

All documents referred to herein are incorporated by reference and all percentages and proportions are by weight, unless otherwise specified.

SUMMARY OF THE INVENTION

The present invention relates to a bottled aqueous household cleaning, fabric treatment or deodorizing product comprising, in addition to water, from 0.01% to 50% of a surfactant and from 0.003% to 5% of a perfume wherein the perfume contains at least 10% of one or more hydrophobic perfume ingredients having a ClogP of greater than 3, and wherein the said product is present in a high density polyethylene bottle and wherein the bottle has a continuous inner surface layer of a material selected from the group consisting of:

a) nylon b) polyethylene terephthalate and c) fluorinated high density polyethylene

DETAILED DESCRIPTION OF THE INVENTION

In accordance with the present invention it has been found that when aqueous household cleaning, fabric treatment or deodorizing compositions comprising water, surfactant and perfume are packaged in conventional high density polyethylene (HDPE) bottles there is a tendency for certain hydrophobic perfume ingredients (i.e. those having a ClogP of about 3 or greater) to be lost from the perfume. This is apparently by migration into and/or through the polyethylene bottle material. When the perfumes contain substantial amounts of such perfume ingredients, such loss considerably alters the intended fragrance character of the perfume. Bottles made of polyethylene terephthalate (PET) or glass do not exhibit this detrimental effect on perfumes. However, consumers prefer plastic containers over glass, and polyethylene is a less expensive plastic than PET. It has now been found that by use of HDPE bottles which have certain interior surface modifications, the loss of these hydrophobic perfume ingredients can be substantially eliminated.

The present invention is a bottled aqueous household cleaning, fabric treatment or deodorizing composition comprising, in addition to water, from 0.01% to 50% of a surfactant and from 0.003% to 5% of a perfume wherein the perfume contains at least 10% of one or more hydrophobic perfume ingredients having a ClogP of greater than 3, and wherein the said composition is present in a high density polyethylene bottle wherein the bottle has a continuous inner surface layer of a material selected from the group consisting of:

a) nylon b) polyethylene terephthalate and c) fluorinated high density polyethylene A. Surfactants Surfactants suitable for use in the compositions of the present invention can be any of those suitable for use in household cleaning, fabric treatment or deodorizing compositions. These include anionic, nonionic, cationic, ampholytic and zwitterionic detergents.

Examples of anionic detergents include $C_8$–$C_{22}$ alkyl sulfates, alkylbenzene sulfonates having from 9 to 15 carbon atoms in the alkyl group, alkyl ethyleneoxide ether sulfates having from 8–22 carbon atoms in the alkyl chain and from 1 to 30 ethylene oxide groups, and $C_8$ to $C_{22}$ fatty acid soaps. Examples of nonionic surfactants include condensates of from 3 to 30 moles of ethylene oxide with an aliphatic alcohol of 8 to 22 carbon atoms, condensates of 5 to 30 moles of ethylene oxide with an alkyl phenol wherein the alkyl contains 9 to 15 carbon atoms, and $C_8$ to $C_{22}$ alkyl dimethyl amine oxides. Examples of ampholytic and zwitterionic surfactants are found in U.S. Pat. No. 3,929,678, Laughlin et al, issued Dec. 30, 1975 at Col, 19, line 38 through Col. 22 line 48. Examples of cationic surfactants are tetraalkyl quaternary ammonium salts having at least one alkyl chain of 8 to 22 carbon atoms, wherein the other alkyl groups can contain from 1 to 22 carbon atoms and wherein the anionic counterion is halogen, ethylsulfate or methylsulfate. The term "household cleaning and fabric treatment and deodorizing compositions" herein includes fabric laundering, softening and freshening compositions, and floor, rug and other household surface treatment compositions where it is desired to clean and/or impart a beneficial treatment or property to the surface. Surtactants are used at levels of from 0.01% to 50%, depending on the intended usage of the product. Typical levels are from 0.1% to 30% and 5% to 20%

Additional surfactants are disclosed in U.S. Pat. No. 3,664,961, Norris, issued May 23, 1972.

B. Perfumes

The compositions of the present invention contain perfumes at levels of from 0.003% to 5%, preferably from 0.003% to 1% and more preferably from 0.05% to 0.2%. The perfumes contain a substantial portion of perfume ingredients (at least about 10%, preferably at least 50%, more preferably at least 70%) which have a ClogP of at least 3.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the Pamona Med Chem/Daylight "CLOGP" program, Version 4.42 available from Biobyte Corporation, Claremont, Calif. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

The following table contains a listing of examples of perfume ingredients having a ClogP of at least 3 which are useful in the present invention.

TABLE I

| Ingredient | ClogP |
|---|---|
| Citronellol | 3.25 |
| Vertenex | 4.06 |
| Terpinyl acetate | 3.58 |
| geranyl acetate | 3.72 |
| Diphenyl methane | 4.06 |
| Lilial (P.T. Bucinal) | 3.86 |
| Hexyl cinnamic aldehyde | 4.85 |
| Cedryl acetate | 5.48 |
| Tonalid | 6.25 |
| d-Limonene | 4.35 |
| Tetrahydro linalool | 3.52 |
| Dihydro myrcenol | 3.03 |
| Benzyl salicylate | 4.21 |
| Gamma methyl ionone | 4.02 |
| Cis-hexenyl salicylate | 4.61 |
| Hexyl cinnamic aldehyde | 4.85 |
| Phentolide | 5.98 |
| Phenyl ethyl phenyl acetate | 3.77 |
| p'Cymene | 4.07 |
| Alpha pinene | 4.18 |
| Isononyl alcohol | 3.08 |

C. Optional Ingredients

In addition to surfactant and perfume, aqueous cleaning, fabric treatment and deodorizing compositions of the present invention can contain the usual adjuvants found in such compositions. These include builders (e.g. phosphates, citrates, polycarboxylates, silicates, etc.), soil suspending agents (e.g. carboxymethyl cellulose), antimicrobial agents (e.g. cyclohexidine, biguanides, etc.), hydrotropes (e.g. sodium cumene sulfonate, propylene glycol), enzymes (e.g. proteases) and polar solvents (e.g. ethanol, ethylene glycol monobutyl ether).

In addition to the perfume ingredients which have a ClogP greater than 3, the perfume can contain perfume ingredients which have a ClogP of less than 3. Examples of such ingredients are shown in Table 2. Perfume ingredients which have a ClogP of less than 3 can be used at levels up to 90% in the perfumes herein.

TABLE 2

| Ingredient | ClogP |
|---|---|
| Amyl acetate | 2.30 |
| Anisaldehyde | 1.78 |

TABLE 2-continued

| Ingredient | ClogP |
|---|---|
| Benzyl acetate | 1.96 |
| Cinnamic alcohol | 1.41 |
| Eucalyptol | 2.76 |
| Citral | 2.95 |
| Ethyl benzoate | 2.64 |
| Camphor gum | 2.18 |
| Dimethyl benzyl carbinol | 1.89 |
| Eugenol | 2.40 |
| Hexyl acetate | 2.83 |
| Isoamyl alcohol | 1.22 |
| Fenchyl alcohol | 2.58 |
| Methyl pentyl ketone | 1.91 |
| Nerol | 2.77 |
| p-Cresol | 1.97 |
| Phenylethyl alcohol | 2.13 |

Preferred compositions herein which have an especially good deodorizing effect on surfaces (e.g. fabrics, carpets, counter tops, etc.) treated with the composition, contain cyclodextrin. In addition to the perfume in the composition providing the desired odor, to the treated surface. Cyclodextrin has the ability to absorb odors such as present in perspiration, urine, etc. present on the treated surface.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. The amount of cyclodextrins used in the compositions will range from 0.01% to about 20%. If the composition is intended to be diluted before use it will contain from 3% to 20%, preferably 5% to 10%. Compositions intended to be used in undiluted form will generally contain from 0.01% to 5%, preferably 0.1% to 3%, more preferably 0.5% to 2%.

When formulating compositions with cyclodextrins, it is desirable to use surfactants which have especially good compatibility with cyclodextrin. Suitable cyclodextrin-compatible surfactants can be readily identified by the absence of effect of cyclodextrin on the surface tension provided by the surfactant. This is achieved by determining the surface tension (in dyne/$cm^2$) of aqueous solutions of the surfactant in the presence and in the absence of about 1% of a specific cyclodextrin in the solutions. The aqueous solutions contain surfactant at concentrations of approximately 0.5%, 0.1%, 0.01%, and 0.005%. The cyclodextrin can affect the surface activity of a surfactant by elevating the surface tension of the surfactant solution. If the surface tension at a given concentration in water differs by more than about 10% from the surface tension of the same surfactant in the 1% solution of the cyclodextrin, that is an indication of a strong interaction between the surfactant and the cyclodextrin. The preferred surfactants herein should have a surface tension in an aqueous solution that is different (lower) by less than about 10%, preferably less than about 5%, and more preferably less than about 1% from that of the same concentration solution containing 1% cyclodextrin.

(a) Block Copolymers

Nonlimiting examples of cyclodextrin-compatible nonionic surfactants include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

Nonlimiting examples of cyclodextrin-compatible surfactants of this type include:

Pluronic Surfactants with the general formula $H(EO)_n(PO)_m(EO)_nH$, wherein EO is an ethylene oxide group, PO is a propylene oxide group, and n and m are numbers that indicate the average number of the groups in the surfactants. Typical examples of cyclodextrin-compatible Pluronic surfactants are:

| Name | Average MW | Average n | Average m |
|---|---|---|---|
| L-101 | 3,800 | 4 | 59 |
| L-81 | 2,750 | 3 | 42 |
| L-44 | 2,200 | 10 | 23 |
| L-43 | 1,850 | 6 | 22 |
| F-38 | 4,700 | 43 | 16 |
| P-84 | 4,200 | 19 | 43, |

and mixtures thereof.

Tetronic Surfactants with the general formula:

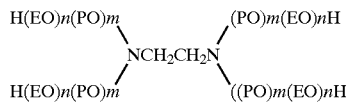

wherein EO, PO, n, and m have the same meanings as above. Typical examples of cyclodextrin-compatible Tetronic surfactants are:

| Name | Average MW | Average n | Average m |
|---|---|---|---|
| 901 | 4,700 | 3 | 18 |
| 908 | 25,000 | 114 | 22, |

and mixtures thereof.

"Reverse" Pluronic and Tetronic surfactants have the following general formulas:

Reverse Pluronic Surfactants $H(PO)_m(EO)_n(PO)_mH$

Reverse Tetronic Surfactants

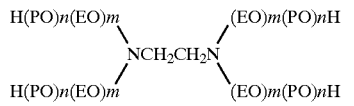

wherein EO, PO, n, and m have the same meanings as above. Typical examples of cyclodextrin-compatible Reverse Pluronic and Reverse Tetronic surfactants are:

Reverse Pluronic surfactants:

| Name | Average MW | Average n | Average m |
|---|---|---|---|
| 10 R5 | 1,950 | 8 | 22 |
| 25 R1 | 2,700 | 21 | 6 |

Reverse Tetronic surfactants

| Name | Average MW | Average n | Average m |
|---|---|---|---|
| 130 R2 | 7,740 | 9 | 26 |
| 70 R2 | 3,870 | 4 | 13 |

and mixtures thereof.

(b) Siloxane Surfactants

A preferred class of cyclodextrin-compatible nonionic surfactants are the polyalkyleneoxide polysiloxanes having a dimethyl polysiloxane hydrophobic moiety and one or more hydrophilic polyalkylene side chains and have the general formula:

$$R^1—CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30 , more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxide/propyleneoxide) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group.

Examples of this type of surfactants are the Silwet® surfactants which are available OSi Specialties, Inc., Danbury, Conn. Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_4O$) in the polyether chain ($R^1$) must be sufficient to render the polyalkyleneoxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7657, and mixtures thereof. Besides surface activity, polyalkyleneoxide polysiloxane surfactants can also provide other benefits, such as antistatic benefits, lubricity and softness to fabrics.

The preparation of polyalkyleneoxide polysiloxanes is well known in the art. Polyalkyleneoxide polysiloxanes of the present invention can be prepared according to the procedure set forth in U.S. Pat. No. 3,299,112, incorporated herein by reference. Typically, polyalkyleneoxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

(c) Anionic Surfactants

Nonlimiting examples of cyclodextrin-compatible anionic surfactants are the alkyldiphenyl oxide disulfonate, having the general formula:

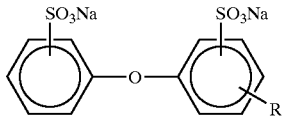

wherein R is an alkyl group. Examples of this type of surfactants are available from the Dow Chemical Company under the trade name Dowfax® wherein R is a linear or branched $C_6$–$C_{16}$ alkyl group. An example of these cyclodextrin-compatible anionic surfactant is Dowfax 3B2 with R being approximately a linear $C_{10}$ group. These anionic surfactants are preferably not used when the antimicrobial active or preservative, etc., is cationic to minimize the interaction with the cationic actives, since the effect of both surfactant and active are diminished.

The surfactants above are either weakly interactive with cyclodextrin (less than 5% elevation in surface tension, or non-interactive (less than 1% elevation in surface tension). Normal surfactants like sodium dodecyl sulfate and dodecanolpoly(6)ethoxylate are strongly interactive, with more than a 10% elevation in surface tension in the presence of a typical cyclodextrin like hydroxypropyl beta-cyclodextrin and methylated beta-cyclodextrin.

Typical levels of cyclodextrin-compatible surfactants in usage compositions are from about 0.01% to about 2%, preferably from about 0.03% to about 0.6%, more preferably from about 0.05% to about 0.3%, by weight of the composition. Typical levels of cyclodextrin-compatible surfactants in concentrated compositions are from about 0.1% to about 8%, preferably from about 0.2% to about 4%, more preferably from about 0.3% to about 3%, by weight of the concentrated composition.

Deodorizing compositions containing cyclodextrin are more fully described in pending Provisional Application No. 60/109834, filed Nov. 25, 1998. HDPE Bottles.

(d) High Density Polyethylene Bottles.

The modified HDPE bottles used in the present invention are modified by having, as their interior surface, a material selected from nylon, polyethylene terephthalate or fluorinated polyethylene, which acts as a barrier to prevent absorption into and/or transmission through the HDPE.

HDPE bottles of this type are known to the art. HDPE bottles with a nylon or PET inner layer can be made by the blow molding process wherein concentric layers of heat softened HDPE, an adhesive, and nylon or PET are formed into a parison and coextruded as a hollow tube into a mold cavity and forced by pressurized air against the walls of the cold mold cavity to form the bottle. The bottle solidifies by cooling to form an HDPE bottle which has an inner surface of nylon or PET.

HDPE bottles having an inner surface of fluorinated HDPE can be made by known methods whereby the inner surface of heated, preformed HDPE bottles are subjected to contact with fluorine gas. The fluorine reacts with the polyethylene to form a layer of fluorinated polyethylene. See *Surface Treatment Improves Polyethylene Barrier Protection Package Engineering,* November, 1981 p.64. Also U.S. Pat. No. 4,081,574, issued Mar. 28, 1964 and U.S. Pat. No. 3,998,180, issued Dec. 21, 1976.

The inner layer of nylon, PET or fluorinated polyethylene should be continuous and have a thickness of at least about 0.0005 in.

The following examples are presented for illustrative purposes, and are not intended to, in any way, limit the scope of the invention.

EXAMPLE I

In this example the following deodorizing composition for inanimate surfaces (e.g. rugs, clothing, counter tops, etc.) containing a perfume, wherein the perfume consisted of approximately 75% ingredients having a ClogP greater than 3 and about 25% ingredients having a ClogP less than 3,was evaluated in HDPE bottles for perfume ingredient loss.

| Ingredient | Parts |
|---|---|
| Silwet 7600* | 0.10 |
| Hydroxypropyl beta cyclodextrin | 1.10 |
| Diethylene glycol | 0.38 |
| Kathon CG** | 0.0003 |
| HCl | 0.001 |
| Perfume | 0.065 |
| Ethanol | 3.00 |
| Water | Balance |

*Alkylethyleneoxide-polysiloxane surfactant from Osi Specialties Inc.
**Antimicrobial from Rhom and Haas The compositions were stored in HDPE bottles for 8 weeks at ambient temperature. After store, gas chromatography analysis was used to determine the amount of the various perfume ingredients remaining in the composition and approximate loss was calculated, based on the amount of each ingredient originally present.

| Perfume Ingredients with Clogp <3 | Perfume Ingredients with Clogp >3 |
|---|---|
| Cineol | Vertenex |
| Linalool | Terpinyl acetate |
| Camphor | Geranyl acetate |
| 2,3-dimethyl octanol | Diphenyl methane |
| Alpha terpineol | Hexyl cinnamic aldehyde |
| Methyl dihydrojasmonate | Phentolid |
| Nerol | Methyl cedrylone major |
| Linalyl formate | Cedryl acetate |
| Eugenol | Tonalid |
| Diethyl phthalate | Benzyl salicylate |
| Dihydromyrcenol | Phenyl ethyl phenyl acetate |
| Ligustral | Gamma-decalactone |
| Phenylethyl alcohol | Gamma-methylionone |
| Beta-terpineol | Beta-ionone |
| Benzyl acetate | Fleuramone |
| MPCA | Alpha-methyl ionone |
| Linalyl acetate | Frutene |
| Sanjinol | Dibenzyl ether |
| Helional | Cis-hexenyl salicylate |
| | Benzyl benzoate |
| | Exaltolide |

Average % Lost=<10>50

This test demonstrates that perfume ingredients of ClogP greater than 3 undergo significant loss when stored in HDPE bottles.

EXAMPLE II

In this example a composition of the same base formula as above, containing 0.065% of the same perfume was placed in several bottle variations and stored at 70° F. and 120° F., respectively.

It had been previously observed that perfume ingredients with ClogP above 3 tend to cause this composition to be cloudy, thus an increase in light transmittance can be used to indicate loss of these ingredients from the composition.

The % light transmittance of product stored in the various bottles is shown below.

| | % Transmittance @ 70° F. | % Transmittance @ 120° F. |
|---|---|---|
| Glass | 2 | 13 |
| HDPE | 97 | 99 |
| Polyvinyl chloride | 92 | 98 |
| HDPE w/$Fl_2$ treated interior | 2 | 32 |
| HDPE w/nylon interior | 2 | 25 |
| Polyethylene terephthalate | 2 | 12 |

These results demonstrate the advantages of the use of modified HDPE bottles in accordance with the present invention.

EXAMPLE III

A fruity lemon perfume suitable for use in the invention is formulated as follows:

| Ingredient | Parts |
|---|---|
| Dihydro myrcenol | 1.0 |
| Alpha pinene | 2.5 |
| p-Cymene | 0.5 |
| Isononyl alcohol | 0.5 |
| Tetrahydro linalool | 45.0 |
| d-Limonene | 44.0 |
| Verdox | 1.0 |
| Camphor gum | 0.5 |
| Dimethyl benzyl carbinol | 1.0 |
| Eucalyptol | 1.0 |
| Fenchyl alcohol | 1.5 |
| Dimetol | 1.5 |

EXAMPLE IV

A liquid fabric softener in accordance with the present invention is made according to the following formula and is packaged in HDPE bottles having an inner surface of PET.

| Ingredient | Parts |
|---|---|
| di(hydrogenated tallow)dimethyl ammonium chloride | 5.25 |
| Perfume of Example III | 1.00 |
| Water | To 100 |

EXAMPLE V

A liquid laundry detergent of the present invention is made to the following formula and is packaged in bottles having an inner surface of fluorinated polyethylene.

| Ingredient | Parts |
|---|---|
| K/Na C13 linear alkylbenzene sulfonate | 7.2 |
| K/Na C14–15 alkyl polyethoxylate(2.25) sulfonate | 10.8 |
| C12–13 alcohol poly(6.5)ethoxylate | 6.5 |
| C12 alkyltrimethyl ammonium chloride | 1.2 |
| C12–14 fatty acid | 13.0 |
| Oleic acid | 2.0 |
| Citric acid (anhydrous) | 4.0 |
| Diethylenetriamine pentaacetic acid | 0.23 |
| Enzyme | 0.91 |
| Ethoxylated tetraethylene pentamine(15–18 mol. EO at each H) | 1.5 |
| Monoethanolamine | 2.0 |
| Propylene glycol | 7.25 |
| Ethanol | 7.75 |
| Formic acid | 0.66 |
| Calcium ion | 0.03 |
| Perfume of Example III | 0.65 |
| Water and minors | To 100 |

What is claimed is:

1. A bottled aqueous household cleaning, fabric treatment or deodorizing composition wherein the composition comprises, in addition to water, from 0.01% to 50% of a surfactant and from 0.003% to 5% of a perfume wherein the perfume contains at least 10% of one or more hydrophobic perfume ingredients having a ClogP of greater than 3, and wherein said composition is contained in a high density polyethylene bottle wherein the bottle has an inner surface layer comprising a material selected from the group consisting of:

a) nylon, b) polyethylene terephthalate, and c) fluorinated high density polyethylene.

2. The bottled composition of claim 1 wherein the amount of perfume in the composition is from 0.003 to 1%.

3. The bottled composition of claim 2 wherein the perfume contains at least 50% of perfume ingredients having a ClogP of greater than 3.

4. The bottled composition of claim 3 wherein the perfume contains at least 70% of perfume ingredients having a ClogP of greater than 3.

5. The bottled composition of claim 3 wherein the perfume level in the composition is from 0.05 to 0.2% and wherein said composition additionally comprises from 0.1% to 20% of cyclodextrin and from 0.15 to 20% of a cyclodextrin-compatible perfume.

6. The bottled composition of claim 5 wherein the inner surface layer of the bottle is nylon.

7. The bottled composition of claim 5 wherein the inner surface layer of the bottle is polyethyleneterephthalate.

8. The bottled composition of claim 5 wherein the inner surface layer of the bottle is fluorinated polyethylene.

* * * * *